US007575284B2

(12) United States Patent
Bettermann et al.

(10) Patent No.: US 7,575,284 B2
(45) Date of Patent: Aug. 18, 2009

(54) MINING PLOW

(75) Inventors: Diedrich Bettermann, Unna (DE); Klaus Duhnke, Bochum (DE); Norbert Hesse, Bochum (DE); Gerhard Siepenkort, Lünen (DE); Adam Klabisch, Dortmund (DE)

(73) Assignee: DBT GmbH (DE)

( * ) Notice: Subject to any disclaimer, the term of this patent is extended or adjusted under 35 U.S.C. 154(b) by 421 days.

(21) Appl. No.: 11/582,529

(22) Filed: Oct. 17, 2006

(65) Prior Publication Data

US 2007/0090677 A1 Apr. 26, 2007

(30) Foreign Application Priority Data

Oct. 17, 2005 (DE) ..... 10 2005 049 971

(51) Int. Cl.
*E21C 27/34* (2006.01)
*E21C 27/32* (2006.01)

(52) U.S. Cl. ..... 299/34.04; 299/34.12

(58) Field of Classification Search ..... 299/34.04, 299/34.12

See application file for complete search history.

(56) References Cited

U.S. PATENT DOCUMENTS

| | | | | |
|---|---|---|---|---|
| 2,689,721 | A * | 9/1954 | Bainbridge | 299/34.04 |
| 4,111,489 | A * | 9/1978 | Beckmann et al. | 299/34.04 |
| 4,453,771 | A * | 6/1984 | Merten et al. | 299/34.12 |
| 4,583,785 | A * | 4/1986 | Breuer et al. | 299/34.09 |
| 4,768,836 | A * | 9/1988 | Nowak | 299/34.12 |

FOREIGN PATENT DOCUMENTS

DE 201 18 259 U1 11/2001

* cited by examiner

*Primary Examiner*—Shane Bomar
(74) *Attorney, Agent, or Firm*—Baker & McKenzie LLP

(57) ABSTRACT

A mining plow with a plow basic body which can be guided on a conveyor and which has on an inclined bearing surface a pivoting bolt for the pivotable mounting of a cutter carrier for each plow travel direction Two cutter carriers are mounted pivotably on respective pivoting bolts by a pivot bearing such that each cutter carrier is guided on a pivoting surface oriented concentrically about the pivot axis of the associated pivoting bolt and formed below the bearing surface on the plow basic body. The pivot bearing of each cutter carrier includes an open-edged receptacle, each cutter carrier being located on the pivoting bolt parallel to the bearing surface in a pivoting mounting position.

15 Claims, 7 Drawing Sheets

MINING PLOW

CROSS-REFERENCE TO RELATED APPLICATION

This application claims priority to German Patent Application No. 10 2005 049 971.6 filed on Oct. 17, 2005.

The invention relates to a mining plow, in particular for coal mining, with a plow basic body which can be guided on a pushable conveyor and which for each plow travel direction has on an inclined bearing surface a pivoting bolt for the pivotable mounting of a cutter carrier, and with two cutter carriers which are mounted pivotably on the respective pivoting bolt by means of a pivot bearing and have a footpart, by means of which the cutter carrier is guided in each case on a pivoting surface oriented concentrically about the pivot axis of the associated pivoting bolt and formed below the bearing surface on the plow basic body.

A generic mining plow in a version as a baseplate plow is known from DE 201 18 259 U1. Owing to the change in the pivoting direction brought about by means of the inclined bearing surfaces for the cutter carriers and because of the support of the cutter carriers on the basic body, it was possible, as compared with the prior art, to reduce the forces introduced into a push rod, via which the two cutter carriers are motionally coupled in terms of their pivoting movement. At the same time, the force direction was oriented better in terms of the axial position of the pushrod, so that jams of the push rod can no longer occur. Moreover, due to the interaction of the inclined bearing surface and of the guide of the cutter carrier, a large-area support of the cutter carrier is achieved at a great distance from the pivot axis. In the generic mining plough, however, an exchange of the cutter carriers at the place of use, for example in an underground longwall, continues to be time-consuming and, because of the low thickness, often presents problems.

The object of the invention is to provide a mining plow, in which, even in the case of low thickness, a mounting of the cutter carriers on the plow basic body and a demounting of the cutter carriers are possible by relatively simple means.

These and further objects are achieved, according to the invention, in that the pivot bearing of the cutter carrier is designed as an open-edged receptacle, by means of which the cutter carrier can be pushed onto the pivoting bolt parallel to the bearing surface in a specific pivoting mounting position of the cutter carrier. In the mining plow according to the invention, use is no longer made, as has been customary hitherto in the prior art, of pivot bearings which are designed as closed depressions in the rear side of the cutter carrier and require a lowering of the cutter carrier after the pivoting bolt and pivot bearing have been set in alignment with one another, but, instead, according to the invention, pivot bearings designed as open-edged receptacles are provided, which, on account of their opening in the edge, make it possible that the cutter carrier can be pushed onto the pivoting bolt, parallel to the bearing surface and consequently perpendicularly to the pivot axis of said pivoting bolt, in a specific pivoting mounting position. During this push-on movement, it is particularly advantageous that the cutter carrier is already supported on the bearing surface. During mounting, therefore, the entire weight of the cutter carrier does not have to be suspended on the support shield by means of a suitable lifting device or the like. Moreover, contact between the cutter carrier and bearing surface during mounting already gives rise to a certain precentering and prealignment between the pivot bearing and the pivoting bolt, so that mounting/demounting can be carried out easily.

In the refinement preferred according to the invention, the receptacle has a U-shaped wall preferably open toward the cutter carrier top side. It is particularly advantageous if the pivoting bolt has a collar which is oriented orthogonally with respect to the pivot axis and which fits into a grooved necking in the wall of the receptacle in the mounting state of the cutter carrier and plow basic body. What is achieved in the mounting state as a result of the interaction of the collar and grooved necking is that the cutter carrier and basic body are positively fixed one to the other in the direction of the pivot axis, but at the same time can be pivoted in relation to one another. For this purpose, it may even be sufficient if the collar at the pivoting bolt end projects only partially beyond the pivoting bolt circumference. For the mounting and a reliable guidance of the cutter carrier out of the pivoting mounting position into the position of use of the cutter carrier, it is further advantageous if the grooved necking in the wall extends continuously as far as the opening of the receptacle forming the pivot bearing.

The pivoting bolt may be welded or screwed to the plow basic body. In the preferred refinement, however, the plow basic body consists of a casting with an integrally cast pivoting bolt.

In order, in spite of the pivot bearing designed as an open receptacle, to hold the cutter carrier in its guided pivoting position on the plow basic body and to support all the weight forces, in the particularly preferred refinement an upper part, comprising the receptacle, of each cutter carrier is provided on its underside with a supporting surface which is oriented concentrically with respect to the pivot axis and which bears against a guide portion oriented on the basic body concentrically with respect to the pivot axis and is supported there, guided pivotably. The supporting surface and the guide portion may in this case preferably cooperate only in a pivoting range in which the cutter carrier is in relation to the basic body in all the normal operating positions. This makes it possible at the same time that the cutter carrier can be pushed onto the respective pivoting bolt essentially from below with the open receptacle. For pivoting into the pivoting mounting position, it is then necessary only to pivot the cutter carrier further by a few degrees, such as, for example, 5 to 30°, out of the range of the pivoting operating positions of the cutter carrier.

Preferably, further, the footpart is provided, on a top side guided on the pivoting surface, with a projecting web which fits into a suitably designed groove in the pivoting surface. This refinement, too, is easy to mount particularly when the cutter carrier can be pushed onto the pivoting bolt essentially from below with the open receptacle, since only then can the footpart web engaging behind the pivoting surface be pushed into the groove on the pivoting surface. In normal operational use, the interaction of the groove and web brings about a further improvement in the guidance of the cutter carrier on the plow basic body, since the cutter carrier is guided at different distances from the pivoting bolt on the plow basic body. For optimal guidance, the pivoting surface and the top side and also the groove bottom and web top side are preferably in each case designed in the form of an arc of a circle curved about the pivot axis.

In order, in normal operational use, to prevent the cutter carrier from being pivoted into the pivoting mounting position in which it could be demounted from the plow basic body, in the particularly preferred refinement a securing piece can be fastened or is fastened in the footpart and engages, with movement play for the cutter carrier pivoting, into a clearance in the pivoting surface on the plow basic body, a demounting of the cutter carrier being possible only when the securing piece is demounted. A demounting of the cutter carrier presupposes that the securing piece is released, since the cutter carrier can only then be pivoted into the pivoting mounting position.

In the mining plow according to the invention, the pivoting movement of the cutter carriers which is dependent on the travel direction is coupled via a pushrod which preferably bears with its ends against side ends of the footparts of the cutter carriers. This, too, leads, together with the measure as described above, to a favorable guidance of the cutter carrier on the plow basic body. As is known per se in mining plows, the maximum pivoting movement of each cutter carrier can be limited adjustably by means of a counterstop adjustable via a control shaft mounted in the basic body. At the same time, by means of the counterstop, it is possible to prevent the securing piece from butting against the boundaries of the associated clearance in the plow basic body when the mining plow is in normal operation.

According to a further advantageous refinement of independent inventive significance, a plurality of cutter pockets for the releasable anchoring of cutters are fastened on the cutter carrier, a cutter pocket or cutter pockets being formed on the footpart for anchoring a floor cutter and a cutter pocket or cutter pockets being formed on the top side of the cutter carrier for the anchoring of roof cutters, in such a way that identically designed floor and roof cutters can be used and anchored on the footpart and on the in each case diagonally opposite upper part end of the other cutter carrier. The use of the floor cutters also as roof cutters makes it possible to have markedly better and cleaner cut surfaces on the topwall and on the footwall, since essentially equal forces are introduced into the mining cutter carrier on the topwall and on the footwall. Moreover, only one cutter system has to be kept in stock for floor and roof cutters.

According to a further inventive refinement of likewise independent inventive significance, exchangeable guide plates which form wearing parts and by means of which the mining plow is guided on the conveyor in operational use are fastened to the rear side of the plow basic body. The guide plates may be fastened to the plow basic body, in particular, by means of a screw and plug connection. For this purpose, the guide plates may preferably be provided with two socket pins arranged on both sides of a screw leadthrough.

Further advantages and refinements of a mining plow according to the invention may be gathered from the following description of an exemplary embodiment shown diagrammatically in the drawing in which.

Figure 1:
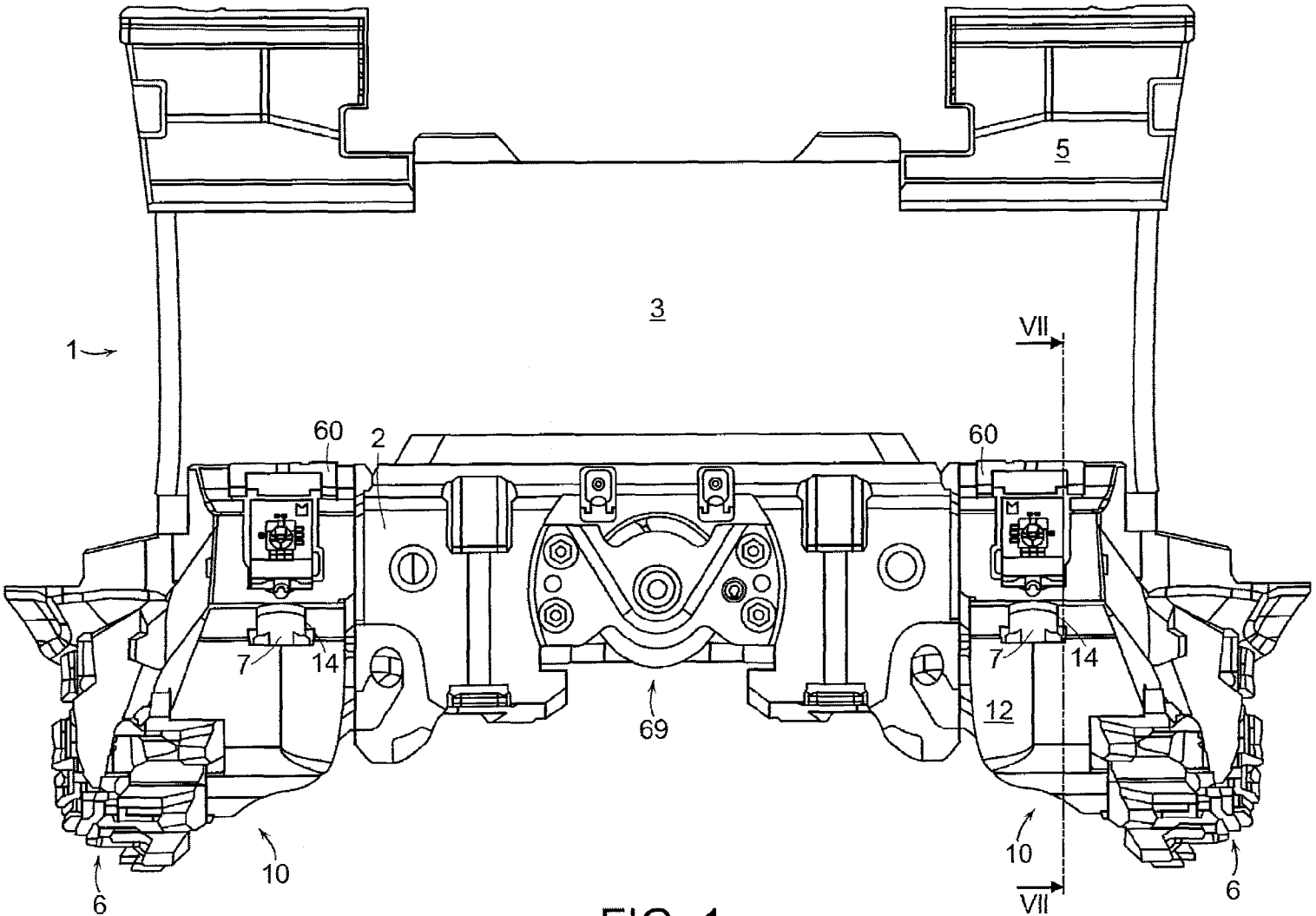
FIG. 1 shows a top view of a mining plow according to the invention.
Figure 2:
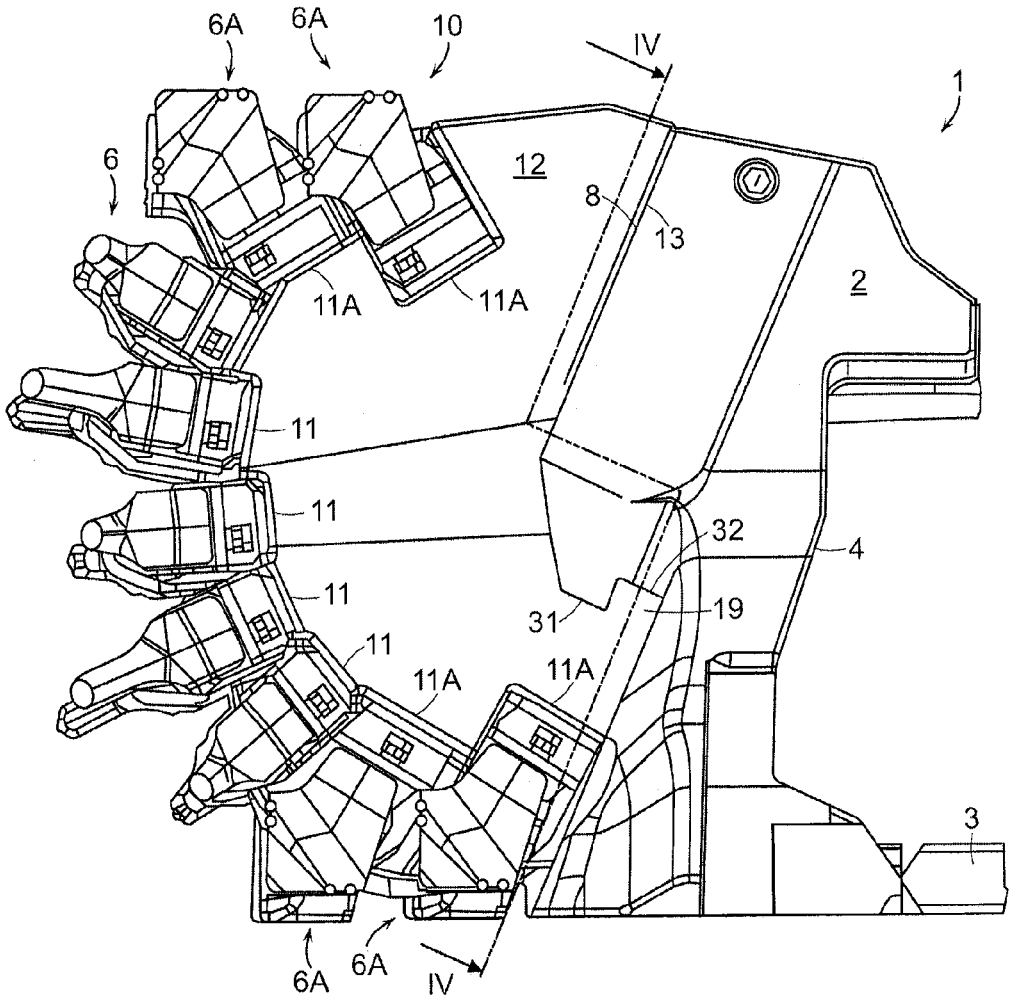
FIG. 2 shows a side view of the mining plow from FIG. 1.

The mining plow, designated in the figures, overall, by reference symbol 1, is illustrated in the embodiment as a baseplate plow and has a plow basic body 2 which is designed as a casting and to which the middle plow baseplate part 3 of a multipart plow baseplate is fastened rigidly. The packing-side rear side 4 of the plow basic body 2 is designed in such a way that the plow 1 can be guided with its plow basic body 2 in a supporting manner on a working face-side guide cheek of a conveyor, not illustrated any further. At the same time, the mining plow engages with its plow baseplate 3 under the two strands of the conveyor, and a guide block 5 at the packing-side end of the plow baseplate 3 engages into a chain guide duct for a plow pull chain for moving the plow 1. In order to mine coal in an underground longwall by means of the mining plow 1, a cutter carrier 10 is fastened pivotably to the plow basic body 2 for each travel direction of the mining plow 1, the two cutter carriers 10 being designed mirror-symmetrically with respect to one another and in each case being equipped, distributed over the height of the mining plow 1, with a plurality of cutters 6 which are anchored in suitable cutter pockets 11 in the cutter carriers 10. Furthermore, an actuating drive 69 for a roof cutter carrier, not illustrated any further, is arranged on the plow basic body 2 between the two cutter carriers 10, so that the mining plow 1 can mine even seam heights which are higher than the basic body 2 or the cutter carriers 10 of the mining plow 1.

According to a particular feature according to the invention which has independent inventive significance, the two cutter carriers 10 are equipped with two identical cutter groups 6A as floor cutters and roof cutters. For this purpose, the cutter carrier 10 has arranged on it, in each case for the roof cutters 6A lying diagonally opposite on the plow basic body 2 and for the floor cutters 6A, cutter pockets 11A which make it possible to anchor identically designed roof and floor cutters 6A.

Figure 7:
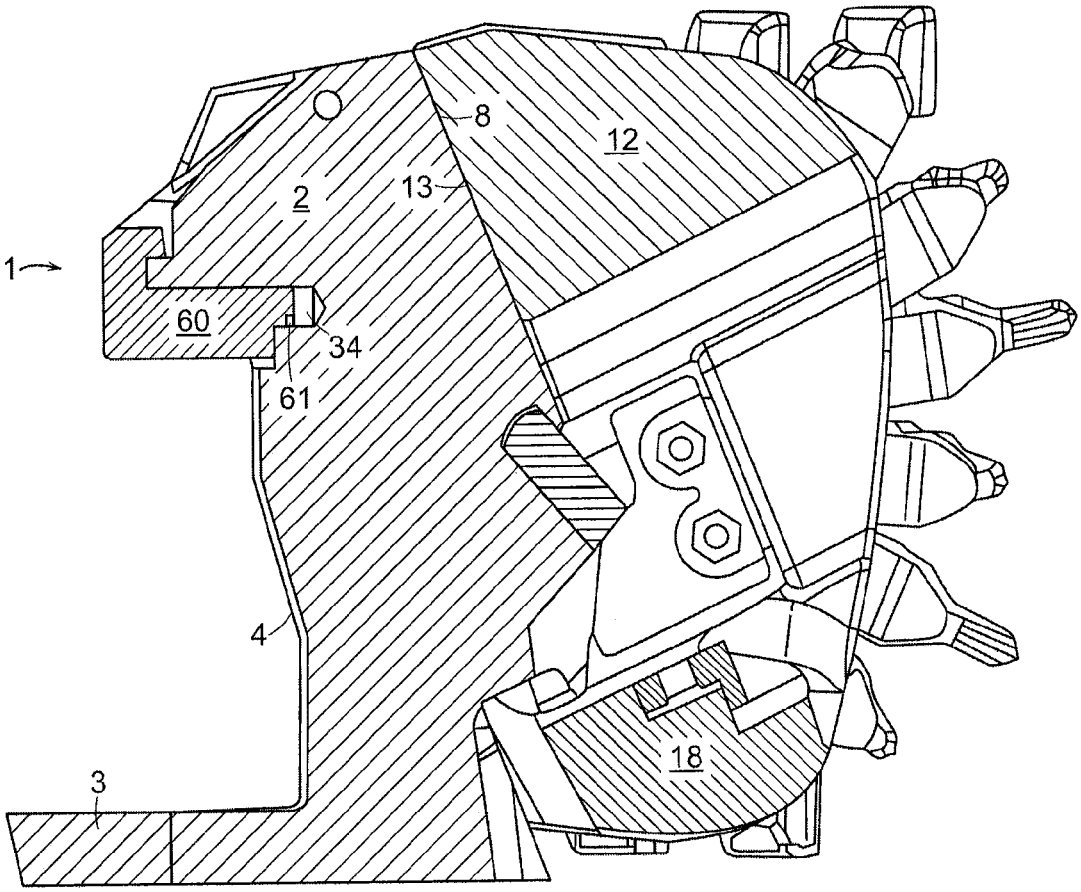
FIG. 7 shows a sectional view along VII-VII in FIG. 1.

The two cutter carriers 10 are fastened pivotably to the plow basic body 2 which, for this purpose, is provided integrally with an associated pivoting bolt 7, as it evident particularly from FIG. 7. The pivot axis S of the two pivoting bolts 7 in this case runs, inclined at an angle of about 25° to the footwall or to the plane of the plow baseplate 3.

Orthogonally with respect to the pivot axis of the two pivoting bolts 7, the plow basic body 2 is provided with a bearing surface 8 which, correspondingly to the inclination of the pivot axis S of the pivoting bolt 7, runs at an inclination of about 65° in relation to the plow baseplate 3 or to the footwall. The two cutter carriers 10 bear with a rear side 13 of an upper part 12 against the inclined bearing surface 8 on the plow basic body 2. The upper part 12 of each cutter carrier 10 has at the same time a pivot bearing cooperating with the pivoting bolt 7. According to the invention, the pivot bearing in the cutter carrier 10 consists in each case of a U-shaped receptacle 14 open toward the cutter carrier top side 12' of the upper part 12. Through the opening of the open-edged receptacle 14, it is possible, in each case in a pivoting mounting position, not illustrated, which lies outside the pivoting position normally assumed by the cutter carrier 10 when the mining plow 1 is in operational use, to bring the cutter carrier 10 to bear with its rear side 13 against the bearing surface 8 of the plow basic body and then to displace said cutter carrier parallel to the bearing surface 8 on the plow basic body 2, until the pivoting bolt 7 is pushed through the opening in the receptacle 14 into the latter.

Figure 4:
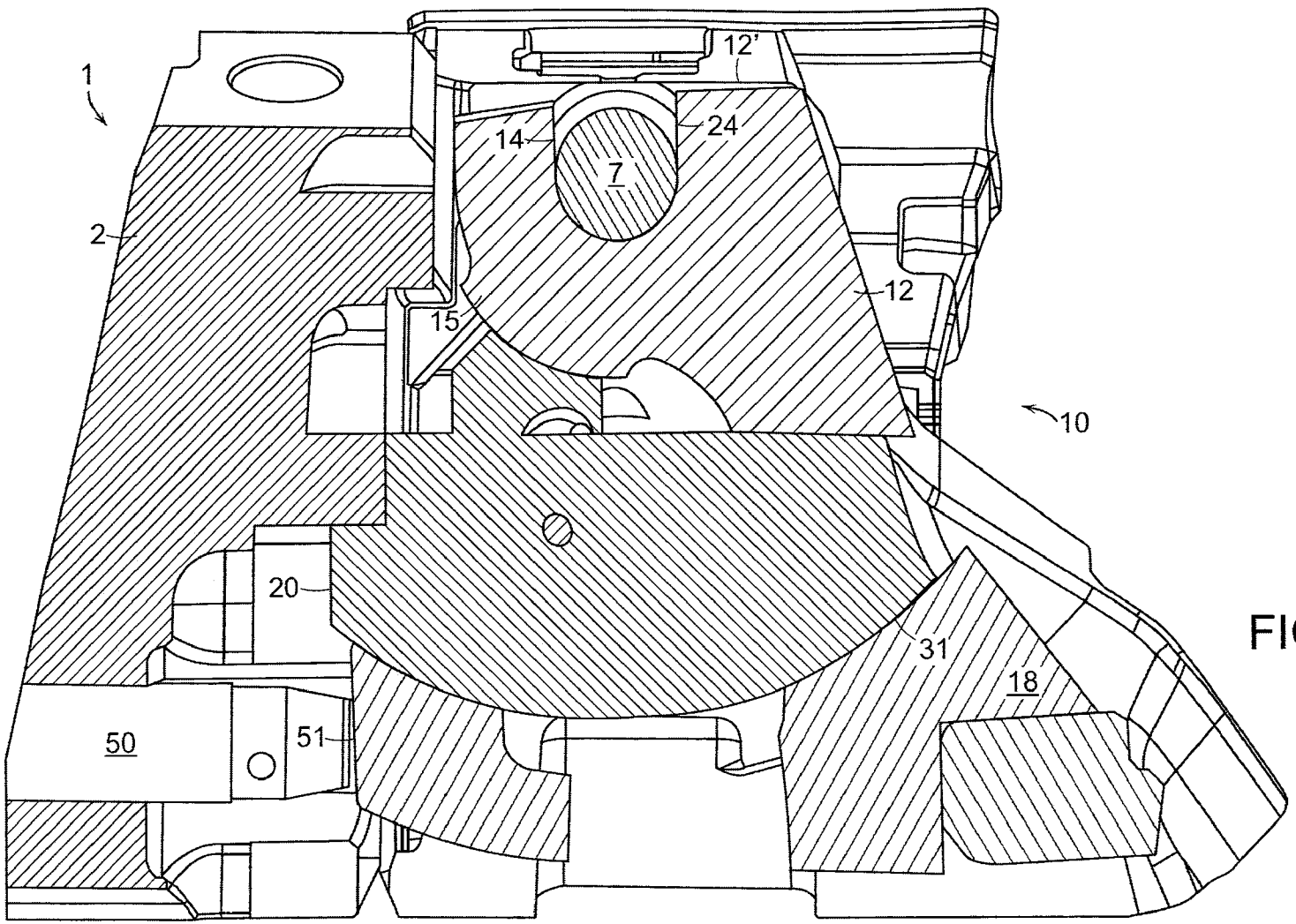
FIG. 4 shows a sectional view along IV-IV in FIG. 2.
Figure 6:
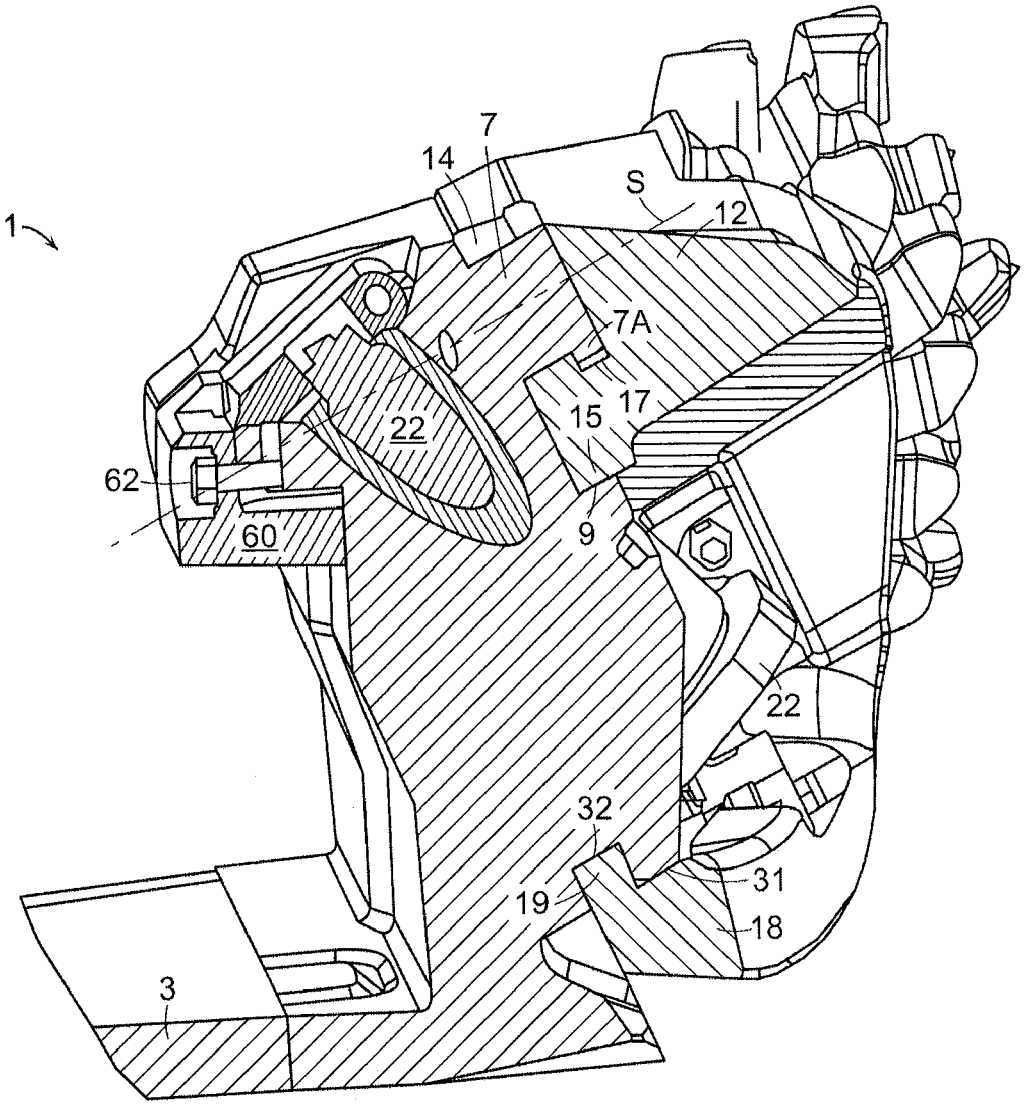
FIG. 6 shows a sectional view along VI-VI in FIG. 3.

In order, in spite of the open-edged receptacle 14, to secure the cutter carrier 10 to the pivoting bolt 7 parallel and perpendicularly to the bearing surface 8 of the plow basic body 2, the underside of the upper part 12, as shown particularly in FIGS. 4 and 6, is provided on a portion with a guide surface 15 which is oriented concentrically about the pivot axis S and is slightly shouldered and which, in the range of the normal pivoting movement of the cutter carrier 10, is supported on a guide portion 9, likewise oriented concentrically about the pivot axis S, on the plow basic body 2 and is guided there. In addition, the pivoting bolt 7 is provided over about 270° of its circumference with a collar 7A which projects orthogonally with respect to the pivot axis or parallel to the bearing surface 8 and which fits into a grooved necking 17, extending as far as the edge of the receptacle 14, in the wall 24 of the receptacle 14. Merely as a result of the interaction of the collar 7A and grooved necking 17 and the guide portion 9 and supporting surface 15 and owing to the bearing of the rear side 13 of the cutter carrier 10 on the inclined bearing surface 8, the weight forces of the cutter carrier 10 can be supported reliably and, at the same time, a reliable guidance of the cutter carrier on the plow basic body 2 can be ensured. As additional guidance, each cutter carrier 10 engages with a footpart 18 under a pivoting surface 31 which is formed below the oblique bearing surface 8 of the plow basic body 2 and which extends concentrically about the pivot axis S. The guidance of the footpart 18 on the pivoting surface 31 is assisted by a projecting web 19 which is located on the top side 18' of the footpart 18 and which fits in a suitably designed groove 32 in the pivoting surface 31 as an additional groove/tongue guide and consequently engages behind the pivoting surface. So as not to impede the pivoting movement of the cutter carrier 10 in relation to the plow basic body 2, the groove bottom of the groove 32 and the web topside of the web 19 in each case again run concentrically about the pivot axis S. In the mining plow 1 according to the invention, engagement behind the pivoting surface 31 as a result of the interaction of the web 19 on the footpart 18 of the cutter carrier 10 and the groove 32 can be achieved in a particularly suitable way during mounting, since the receptacle 14 as a pivot bearing for the pivoting bolt 7 is open at the edge, and in the pivoting mounting position the cutter carrier 10 can be pushed with its pivot bearing onto the pivoting bolt perpendicularly to the pivoting surface.

Figure 3:
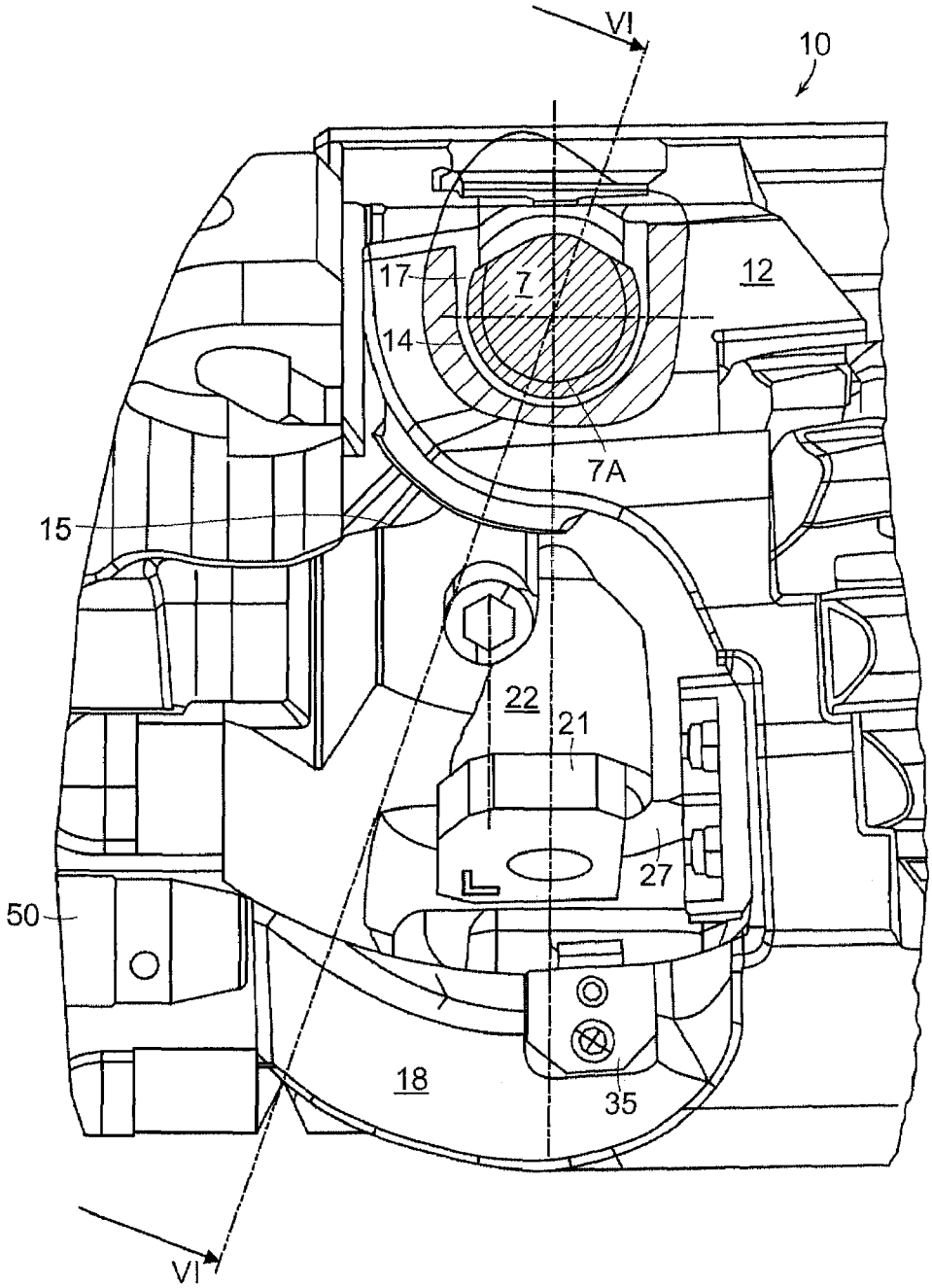
FIG. 3 shows a partially cutaway view of a detail of a cutter carrier.
Figure 5:
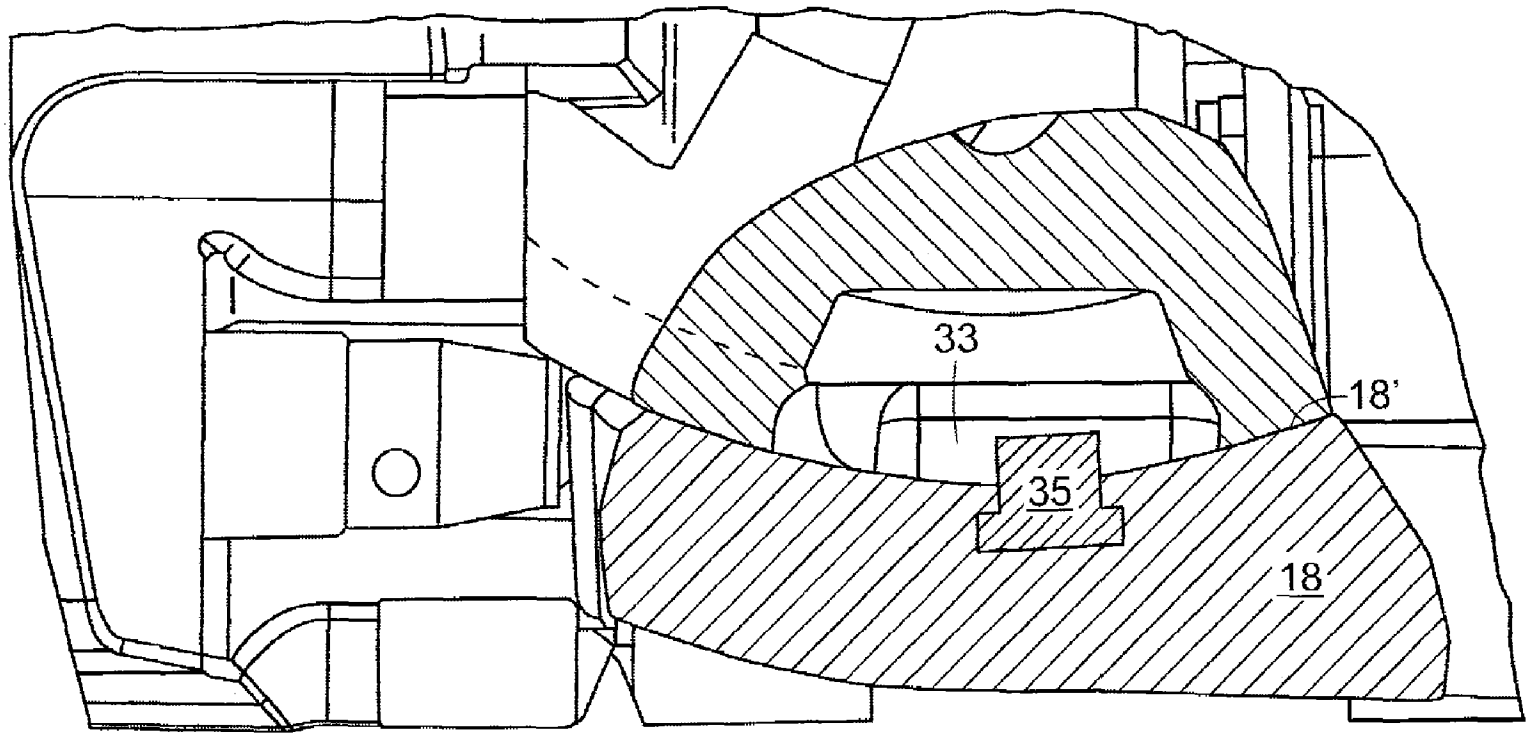
FIG. 5 shows a partially cutaway view of a detail of the footpart of a cutter carrier.

In the mining plow 1 according to the invention, as is known per se for baseplate plows, a change in the pivoting position of the two cutter carriers 10 is achieved via a positive coupling of the two cutter carriers 10 by means of a pushrod 50. The pushrod passing through the plow basic body 2 in each case presses with its preferably convex pushrod heads 51 against a side flank 20 of the footpart 18. Depending on the travel direction of the mining plow 1, the contact of the cutters on the cutter carrier 10 with the working face has the effect that the cutter carrier 10 located at the front in the travel direction is lowered and pressed against the footwall, with the result that the pushrod 50 is displaced and presses away the cutter carrier 10, located in each case in the rear in the travel direction, upward and slightly rearward, with the result that the corresponding trailing cutter carrier performs no mining work during the travel of the mining plow 1 in this travel direction. The maximum pivoting movement of the two cutter carriers 10 may in this case be limited in a way known per se by means of fixed counterstop 27 on the cutter carrier 10 and of a stop head 21 which is provided with eccentric stops and which can be adjusted via a control shaft 22 which is mounted in the plow basic body 2 and rises as far as the top side of the latter. However, independently of the counterstop 21, in order, when the mining plow 1 is in operational use, to prevent one of the cutter carries 10 from being capable of assuming a pivoting position in which, for example, the supporting surface 15 comes free of the guide portion 9 on the plow basic body 2, in the footpart 18 of each cutter carrier 10, as shown particularly in FIGS. 3 and 5, a securing piece 35 is inserted releasably, which projects with a portion beyond the concentrically curved topside 18', guided on the pivoting surface 31, of the footpart 18. The securing piece 35 engages into a clearance 33, of which the arc length about the pivot axis S is admittedly slightly greater than the pivoting distance by the amount of which each cutter carrier 10 is pivoted during normal operational use, but at the same time is smaller than the pivoting distance by the amount of which a cutter carrier 10 would have to be pivoted in order to arrive at the pivoting mounting position in which a demounting or mounting of a cutter carrier 10 can take place. Consequently, only when the securing piece 35 is demounted can a cutter carrier 10 be pivoted into the pivoting mounting position which allows demounting.

As a further particular feature of independent inventive significance, two guide plates 60 are fastened releasably, spaced apart from one another, as exchangeable wearing parts on the packing-side rear side 4 of the plow basic body 2, the guide plate 60 lying on a working face-side guide profile of the conveyor when a mining plow 1 is in operational use, in order to protect the plow basic body 2, preferably consisting of a casting, against excessive wear. The two guide plates may consist of wear-resistant material or be provided with wearing inserts. In order to fix the two guide plates 60 sufficiently firmly in terms of all the forces occurring in the travel direction during mining travel, the guide plates 60 in each case comprise two socket pins or tenons 61 which are formed at a short distance from one another and project on one end face and which fit positively into associated mortises 34 in the plow basic body 2. The retention and securing of the guide plates 60 take place additionally by means of a screw connection, in that a fastening screw 62, which is arranged between the two tenons 61, is secured to the plow basic body 2 in a suitable way.

Numerous modifications which are to come within the scope of the protection of the appended patent claims may be gathered from the foregoing description by a person skilled in the art. The arrangement of the cutters may also take place in another way. The figures show only one preferred exemplary embodiment, and in this case the part lengths of the surfaces and parts cooperating with one another and also the angles at which individual parts are arranged may be changed slightly. The securing piece could also be fastened releasably to the plow basic body.

The invention claimed is:

1. A mining plow, comprising:

a plow basic body guidable on a pushable conveyor;

a first bearing surface and a second bearing surface each located on the plow basic body;

a first pivoting bolt located on the first bearing surface;

a second pivoting bolt located on the second bearing surface;

a first cutter carrier mounted on the first pivoting bolt, the first cutter carrier including a first pivot bearing and a first footpart;

a second cutter carrier mounted on the second pivoting bolt, the second cutter carrier including a second pivot bearing and a second footpart;

a first pivoting surface oriented concentrically about a pivot axis of the first pivoting bolt and below the first bearing surface; and a second pivoting surface oriented concentrically about a pivot axis of the second pivoting bolt and below the second bearing surface, wherein the first pivot bearing includes a first open edged receptacle;

the second pivot bearing includes a second open edged receptacle;

the first cutter carrier is located on the first pivoting bolt parallel to the first bearing surface in a pivoting mounting position; and the second cutter carrier is located on the second pivoting bolt parallel to the second bearing surface in a pivoting mounting position.

2. The mining plow of claim 1, wherein the first and second open edged receptacles each include a U-shaped wall that is open toward a top side of the respective cutter carrier.

3. The mining plow of claim 1, further comprising:

a first collar located on the first pivoting bolt;

a second collar located on the second pivoting bolt;

a first grooved necking located in a wall of the first open edged receptacle; and a second grooved necking located in a wall of the second open edged receptacle, wherein each of the first and second collars is oriented orthogonally with respect to the pivot axis of the respective pivoting bolt; and the first and second collars fit into the first and second grooved neckings, respectively.

4. The mining plow of claim 3, wherein the first and second collars extend partially beyond a circumference of the respective first and second pivoting bolt.

5. The mining plow of claim 3, wherein the first and second grooved neckings in the wall each extend to an edge opening of the respective receptacle.

6. The mining plow of claim 1, wherein the plow basic body includes a casting having integrally cast pivoting bolts.

7. The mining plow of claim 1, further comprising:

a first projecting web located on a top side of the first footpart; and a second projecting web located on a top side of the second footpart;

a first pivoting surface including a first groove; and a second pivoting surface including a second groove, wherein each of the first and second projecting webs fit into a corresponding first and second groove located in the respective first and second pivoting surface.

8. The mining plow of claim 7, wherein each of the first and second pivoting surfaces, the top sides of the first and second projecting webs, and a bottom of each of the first and second grooves are formed as an arc.

9. The mining plow of claim 1, further comprising:

a first securing piece located in the first footpart;

a second securing piece located in the second footpart;

a clearance in the first pivoting surface;

a clearance in the second pivoting surface, wherein the first and second securing pieces engage with the clearances of the first and second pivoting surfaces, respectively; and the first and second cutter carriers are demountable from the plow basic body when the respective first and second securing pieces are not engaged with the respective clearances of the first and second pivoting surfaces.

10. The mining plow of claim 1, further comprising:

a pushrod including at least a first pushrod head and a second pushrod head, wherein the first pushrod head is positioned in contact with the first footpart;

the second pushrod head is positioned in contact with the second footpart; and a pivoting movement of each of the first and second cutter carrier is based upon a direction of motion of the mining plow and is controlled via the pushrod.

11. The mining plow of claim 1, further comprising:

a first stop head adjustable via a first control shaft mounted on the basic body; and a second stop head adjustable via a second control shaft mounted on the basic body, wherein a maximum pivoting movement of each of the first cutter carrier and the second cutter carrier is limited by the first and second stop head, respectively.

12. The mining plow of claim 1, further comprising a plurality of cutter pockets fastened on at least one of the first cutter carrier or the second cutter carrier, the plurality of cutter pockets being operable for the anchoring of cutters, wherein at least one cutter pocket is formed on at least one of the first footpart or the second footpart for the anchoring of foot cutters; and at least one cutter pocket is formed on an upper part of the respective cutter carrier for the anchoring of roof cutters and for an anchoring of identical diagonally-opposite floor and roof cutters.

13. The mining plow of claim 1, further comprising a plurality of exchangeable guide plates operable for guiding the mining plow on the conveyor, wherein the plurality of exchangeable guide plates are fastened to a rear side of the plow basic body.

14. The mining plow of claim 13, wherein the plurality of exchangeable guide plates are fastened to the basic body by a screw and plug connection.

15. The mining plow of claim 14, wherein each of the plurality of exchangeable guide plates include one of two socket pins or two tenons arranged on both sides of a screw leadthrough.

* * * * *